US007647967B2

(12) United States Patent
Coleman, II et al.

(10) Patent No.: US 7,647,967 B2
(45) Date of Patent: Jan. 19, 2010

(54) DRILLING AND OPENING RESERVOIR USING AN ORIENTED FISSURE TO ENHANCE HYDROCARBON FLOW AND METHOD OF MAKING

(75) Inventors: James K. Coleman, II, Bloomington, IN (US); Norman C. Hester, Bloomington, IN (US)

(73) Assignee: Jimni Development LLC, Bloomington, IN (US)

( * ) Notice: Subject to any disclaimer, the term of this patent is extended or adjusted under 35 U.S.C. 154(b) by 223 days.

(21) Appl. No.: 11/614,307

(22) Filed: Dec. 21, 2006

(65) Prior Publication Data

US 2007/0158072 A1 Jul. 12, 2007

Related U.S. Application Data

(60) Provisional application No. 60/758,523, filed on Jan. 12, 2006.

(51) Int. Cl.
*E21B 43/26* (2006.01)

(52) U.S. Cl. ..... 166/271; 166/259

(58) Field of Classification Search ..... 166/298, 166/259, 271, 278, 50; 299/35, 15, 34.01; 125/21

See application file for complete search history.

(56) References Cited

U.S. PATENT DOCUMENTS

| | | | | |
|---|---|---|---|---|
| 733,073 | A * | 7/1903 | Neukrch | 299/19 |
| 753,092 | A * | 2/1904 | Neukirch | 299/35 |
| 2,796,129 | A | 6/1957 | Brandon | |
| 4,232,904 | A | 11/1980 | Hurd | |
| 4,442,896 | A | 4/1984 | Reale et al. | |
| 4,858,689 | A * | 8/1989 | Logan | 166/256 |
| 4,950,034 | A | 8/1990 | Reid | |
| 5,003,795 | A | 4/1991 | Hoke | |
| 5,033,795 | A | 7/1991 | Farrar et al. | |
| 5,957,624 | A | 9/1999 | Carter, Jr. et al. | |
| 6,280,000 | B1 | 8/2001 | Zupanick | |
| 2003/0205174 | A1 | 11/2003 | Carter, Jr. | |

* cited by examiner

*Primary Examiner*—David J Bagnell
*Assistant Examiner*—Cathleen R Hutchins
(74) *Attorney, Agent, or Firm*—Overhauser & Lindman, LLC

(57) ABSTRACT

A system and method for increasing hydrocarbon production from a subsurface reservoir by utilizing an intersection of two well bores and a flexible linear cutting device, such as a segmented diamond wire saw, to form a fissure beginning at the intersection of the well bores and extending along a specified the length of the well bores. The ends of the cutting device can be actuated above ground. The shape of the fissure can be a substantially ruled surface defined between the two bores between which the fissure is formed. Configurations for the well bores include both bores extending from the surface and, alternatively, a first bore extending from the surface and a second bore extending from a whipstock in the first bore. The fissure may be located and oriented to maximize the extent of the fissure formed within the hydrocarbon bearing horizon and to intersect with a maximum number of natural and/or previously formed fractures.

7 Claims, 7 Drawing Sheets

DRILLING AND OPENING RESERVOIR USING AN ORIENTED FISSURE TO ENHANCE HYDROCARBON FLOW AND METHOD OF MAKING

CROSS-REFERENCE TO RELATED APPLICATIONS

This application claims the benefit of U.S. Provisional Application No. 60/758,523, filed Jan. 12, 2006.

BACKGROUND

The present invention relates to well drilling operations, and particularly, to increasing the contact area for hydrocarbon recovery in hydrocarbon bearing horizons of various rock types and widely varying thicknesses.

The production rate of a hydrocarbon producing well is for the most part directly related to the surface or contact area formed within the hydrocarbon bearing horizon through the process of drilling. Additionally, the smaller the contact area the more likely there will be excessive hydrocarbon flow rates in the target zone that will likely force sand or other residue into the flow path, thus creating obstacles and potentially clogging and slowing the hydrocarbon production flow. For example, residue may be forced into narrow fractures, well casings, and other production equipment, blocking the free flow of hydrocarbons.

Hydrocarbon bearing horizons occur as horizontal or subhorizontal layers of varying shapes and thicknesses known as traps. The depths below the surface of the earth at which these traps occur vary widely from a few hundred to thousands of feet. Increasing the contact area in such horizons is typically achieved by (1) creating fractures in the rock by hydro-fracturing, (2) using directional drilling techniques to maximize the length of the bore extending into the reservoir, for example, by redirecting the bore to a horizontal or subhorizontal orientation within the horizon, (3) drilling multiple lateral bores that deviate or extend from the main bore and into multiple target zones within the horizon.

Well bores are generally drilled with rotary rock cutting bits using a mix of water and mud or using compressed air to remove residue generated by the drilling process. The typical bore diameter of the bit used for penetrating the horizons of its hydrocarbon producing potential is 6⅞" in diameter. Drilling larger diameter bores to the depth of the target zone within the hydrocarbon bearing horizon is generally cost prohibitive; therefore, the contact area, which is determined by the surface area of the cylinder defined by the bore, is somewhat limited and expensive to increase when achieved by well bores alone.

Creating fractures within the horizon in order to increase the contact area is typically achieved by using pressure, for example, by pumping large volumes of water or other fluids into the target zone of the horizon, a process called hydro-fracturing. Although this typical fracturing technique creates fissures that increase the contact area, it is difficult to accurately predict or control the plane through which the fissure is created and the expanse of the fissure.

For rock formations at a depth of less than 2000 feet, the fracturing generally extends in a substantially horizontal plane, whereas as for formations at depths greater than 2000 feet, the dominant fractures are vertical. In some formations fractures are the only porosity available for hydrocarbon flow to the well bore. Depending on the geological characteristics of the reservoir (target zone), the resulting fissure may not extend to the desired span, may be in the same plane as natural fissures and therefore not intersect them, or the fissure may extend beyond the target zone and into material other than the target zone. If this zone is water bearing, the fracturing process has the potential for making the well unsuitable for further production. Some rock types may not be suitable for using conventional methods of fracturing, for example shales. It is also difficult to control the thickness of fissures formed by hydro-fracturing or other conventional techniques, thus limiting the ability to control clogging of the fissures. Hydraulically non-uniform features, clogging, or other production problems in the well relating to fracturing can be costly problems to overcome, if they can be overcome at all.

SUMMARY

A system and method for increasing hydrocarbon production from a subsurface reservoir utilize the intersection of two well bores and a flexible linear cutting device, such as a wire saw, to form a fissure beginning at the intersection of the well bores and extending along the length of the well bores. The ends of the cutting device can be actuated above ground, through the wellheads formed by the bores. The fissure increases the contact area of the well, thus increasing hydrocarbon production. The orientation, span, and shape of the fluid flow enhancing fissure are determined by the placement of the two bores between which the fissure is formed.

The present invention may comprise one or more of the following features or combinations thereof. An illustrative embodiment of a well system for a hydrocarbon zone includes a first bore having proximal and distal ends, the proximal end forming a wellhead; a second bore having a first intersection with the first bore; and a fissure defined between and spanning at least a portion of the length of the first bore and the second bore, the fissure having a distal end at the first intersection of the first and second bores. The fissure defines a substantially ruled surface. The ruled surface can be oriented substantially horizontal. The at least one of the first and second bore can have at least a portion oriented substantially horizontal within the hydrocarbon zone. The ruled surface can be oriented substantially vertically. A proximal end of the second bore forms a wellhead. The proximal end of the second bore forms a second intersection with the first bore at a point between the first intersection and the proximal end of the first bore.

Another illustrative embodiment of a system for forming a subterranean fissure extending along a length of a first and a second bore, includes a wellhead defined by a proximal end of the first bore; a first intersection defined by a junction of the first and second bore; and a flexible linear cutting device extending through the first intersection. The system can further include a wellhead defined by a proximal end of the second bore. The system can further include a second intersection defined by the first bore and a proximal end of the second bore, the second intersection between the first intersection and the proximal end of the first bore. The flexible linear cutting device includes a wire saw. The flexible linear cutting device includes at least one of a chain, a wire-type saw, a high-pressure fluid cutting jet, an electromechanical cutter, and an electromagnetic cutter. The system can further include at least one actuator for translating the flexible linear cutting device. The at least one actuator can be located below the surface in at least one of the first bore and the second bore.

An illustrative embodiment of a method of increasing hydrocarbon primary or secondary recovery includes providing a first bore having proximal and distal ends, the proximal end forming a wellhead; providing a second bore having a first intersection with the first bore; and forming a fissure beginning at the first intersection and spanning between at least a portion of the length of the first bore and the second bore. The step of providing a second bore includes a proximal end of the second bore forming a wellhead. The step of providing the second bore includes the second bore having a second intersection with the first bore. The step of forming a fissure includes positioning a flexible linear cutting device through the first and second bores; and actuating the flexible linear cutting device to form the fissure. The step of actuating the flexible linear cutting device includes tensioning the flexible linear cutting device; and translating the flexible linear cutting device in a linear reciprocating pattern. The step of positioning a flexible linear cutting device includes coupling opposite ends of the flexible linear cutting device; and the step of actuating the flexible linear cutting device includes tensioning in the flexible linear cutting device; and translating the flexible linear cutting device in a non-reciprocating, rotary pattern. The step of forming a fissure includes providing a non-uniform kerf.

These and additional features of the disclosure will become apparent to those skilled in the art upon consideration of the following detailed description of the illustrative embodiments.

DESCRIPTION OF THE ILLUSTRATIVE EMBODIMENTS

Figure 1:
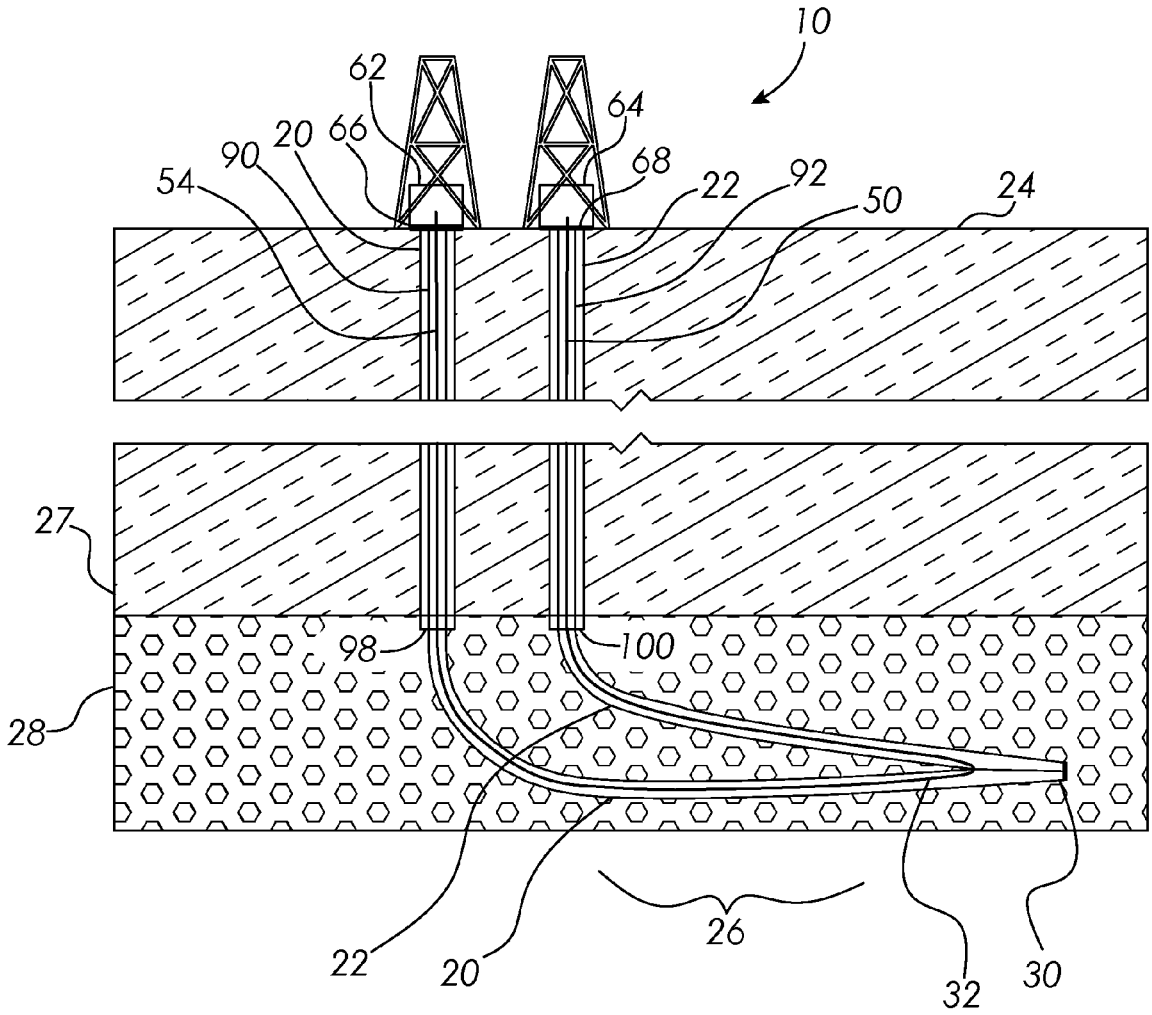
FIG. 1 illustrates a vertical cross-sectional view of an illustrative embodiment of the invention having two bores extending from the surface, the bores having portions extending substantially parallel to and within a hydrocarbon bearing horizon.

For the purposes of promoting and understanding the principles of the invention, reference will now be made to one or more illustrative embodiments illustrated in the drawings and specific language will be used to describe the same. It will nevertheless be understood that the one or more illustrative embodiments are not intended to limit the scope of the claims, but rather to disclose one or more illustrative embodiments among a broader range of possible embodiments that may be within the scope of the claims.

The present system and method for increasing hydrocarbon production from a subsurface reservoir, the system and method utilizing an intersection of two well bores and a flexible linear cutting device, such as a segmented diamond wire saw, to form a fissure beginning at the intersection of the well bores and extending along a specified the length of the well bores. Hydrocarbon production may be in the form of petroleum oil or gas, and hydrocarbons may be diluted by water or other substances.

The shape of the fissure is a substantially ruled surface defined by the two bores between which the fissure is formed. Configurations for the well bores include both bores extending from the surface and, alternatively, a first bore extending from the surface and a second bore extending from a whipstock of the first bore. Both bores may have a portion extending substantially parallel to and within a hydrocarbon bearing horizon to maximize the span of the fissure formed within a target zone. The fissure may be formed with a non-uniform thickness to prevent closure, for example from swelling. The fissure may also be located, oriented, sized, and shaped to intersect a maximum number of natural and/or previously formed fissures or fractures.

A first end of the cutting device can be inserted into a first well bore and that end fished up through an intersecting well bore while the second end of the cutting device is retained through the first bore. The cutting device may be fished using fishing tools well known to those skilled in the art of fishing cables from well bores, including, for example, the use of under-reamers to enlarge the well bores in the area of the intersection. The ends of the cutting device can be actuated above ground, through one or two wellheads formed by the bores. The resulting fissure can have a thickness (kerf) many times greater than is formed by hydro-fracturing. Closure of the fissure from swelling or from the weight of the overburden (above located earth) can be minimized by using a cutting device that provides a fissure of varying thickness thereby providing opposing protrusions on the walls of the fissure that prevent complete closure. Additionally, because of the manner in which the fissure is produced, the fissure can easily be filled with packing material as it is being created without requiring the use of excessive pressure, for example, as is the case with hydro-fracturing when using sand as a propping agent.

While in a production state, one well bore can be used for access, maintenance, drainage, and the like while the other well bore is used for or remains configured for continuous hydrocarbon production. For example, maintenance may include removal of drilling fluids, removal of water or other impurities separated down hole, acid injection, and flushing of plugged fissures. Sand, paraffin, and other residue may plug fissures, requiring them to be flushed with solvents such as acid and/or diesel fuel.

The present systems and methods can be used for primary and/or secondary recovery of hydrocarbons. Maximizing the contact area according to the present systems and methods increases the overall hydrocarbon production rate, while reducing intense areas of flow, thus reducing problems related to high flow rates or high total flow volumes over the life of a well completion, for example, sand transport and plugging. Additionally, conventional techniques of injecting fluids or gasses, such as carbon dioxide or steam, through the fissure and into the formation can be used with the present systems and methods to enhance production of hydrocarbons, for example, by removing residue or otherwise affecting the properties of the surrounding formation to enhance production. Also, known methods of hydro-fracturing can also be used in conjunction with fissures created using the present system and methods.

Referring to FIG. 1, which is a vertical cross-sectional view, an illustrative embodiment of a first system 10 includes two bores 20 and 22 extending from the surface 24. The first bore 20 and the second bore 22 can include portions substantially parallel to and located within a target zone 26 of a hydrocarbon bearing horizon 28. The exact geometry and relative placement of the first and second bores 20 and 22 is predetermined in order to maximize the advantages of the formation characteristics within the target zone 26. For example, the first and second bores 20 and 22 can be drilled using directional and guided drilling techniques known in the art to maintain and orient the bores within the target zone 26 and to form an intersection 30 of the bores 20 and 22. For example, measurement while drilling guidance techniques can be used, including, for example, radar (for example, techniques such as those disclosed by U.S. Pat. No. 6,633,252 (titled: Radar Plow Drillstring Steering), U.S. Pat. No. 6,522,285 (titled: Ground-Penetrating Imaging and Detecting Radar), and U.S. Pat. No. 6,593,746 (titled: Method and System for Radio-imaging Underground Geologic Structures), the disclosures of which are incorporated herein by reference), gamma ray and sonic logging, providing a reference transmitter down one or both bores 20 and 22 and/or at the surface 24, and one or more receivers at the surface and/or down one or both well bores 20 and 22, or other sensor based measurement and guidance techniques. The hydrocarbon bearing horizon 28 may be, for example, 20 feet or less in thickness.

The first and second bores 20 and 22 form the intersection 30 within the target zone 26, for example at or near the distal ends of one or both of the bores 20 and 22. While the interior angle formed by the intersection 30 of the bores 20 and 22 is generally an acute angle such as is required for maintaining bores 20 and 22 within a thin target zone 26, the present systems and methods may also include intersections 30 that are 90 degrees or greater.

Figure 2:
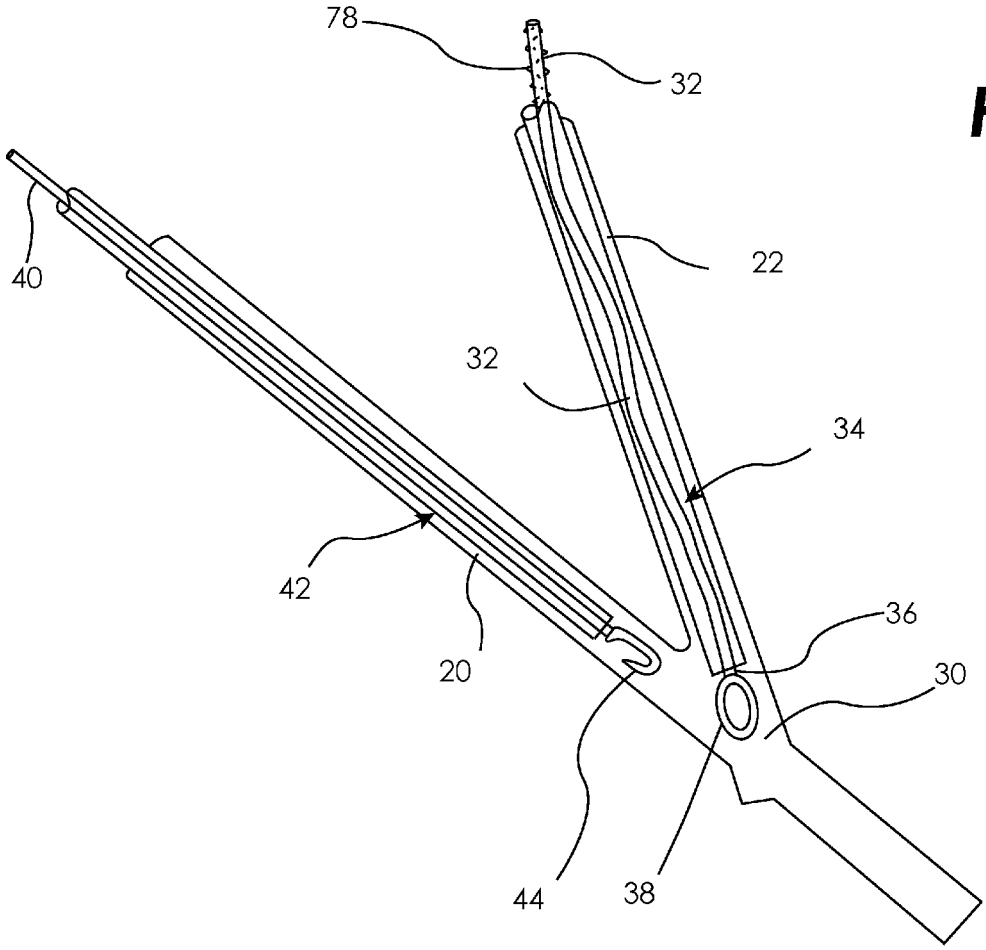
FIG. 2 illustrates an illustrative fishing operation used to extend a flexible linear cutting device through the intersection of two well bores.

Referring now to FIG. 2, which is a close-up of the intersection 30 of the system 10 shown in FIG. 1, conventional cable fishing tools can be used to position a flexible linear cutting device through the intersection 30. For example, FIG. 2 illustrates an exemplary method of fishing a wire saw 32, for example, a segmented diamond wire saw such as those used for quarrying rock in the dimension stone industry and available from W. F. Meyers Company, Inc. of Bedford, Ind. Specifically, a non-collapsible device, for example a cable pushing sub at the distal end of tubing string 34, can be used to extend a first end 36 of the wire saw 32 down the second bore 22 so that a connector 38 or similar device coupled to the end 36 of the wire saw 32 is positioned within the intersection 30. Such subs for conveying wire line tools downward in highly deviated wells are is known in the art, for example, such as the Well Tractor available from (and a trademark of) Weltec, Inc, of Houston, Tex. Similarly, a rigid or non-rigid retrieving line 40 can be inserted down through the well bore 20, for example using a second sub and/or tubing string 42. The distal end of the retrieving line 40 includes a hook 44 or other mechanical or electromechanical device to capture the connector 38. Upon capture of the connector 38, the retrieving line 40 is used to pull the first end 36 of the wire saw 32 into the first bore 20. For example, the first end 36 of the wire saw 32 may be pulled into the first bore 20 until the connector 38 can be accessed at the surface 24, or until approximately equal lengths of the wire saw 32 are located in each of the first bore 20 and the second bore 22.

Figure 3:
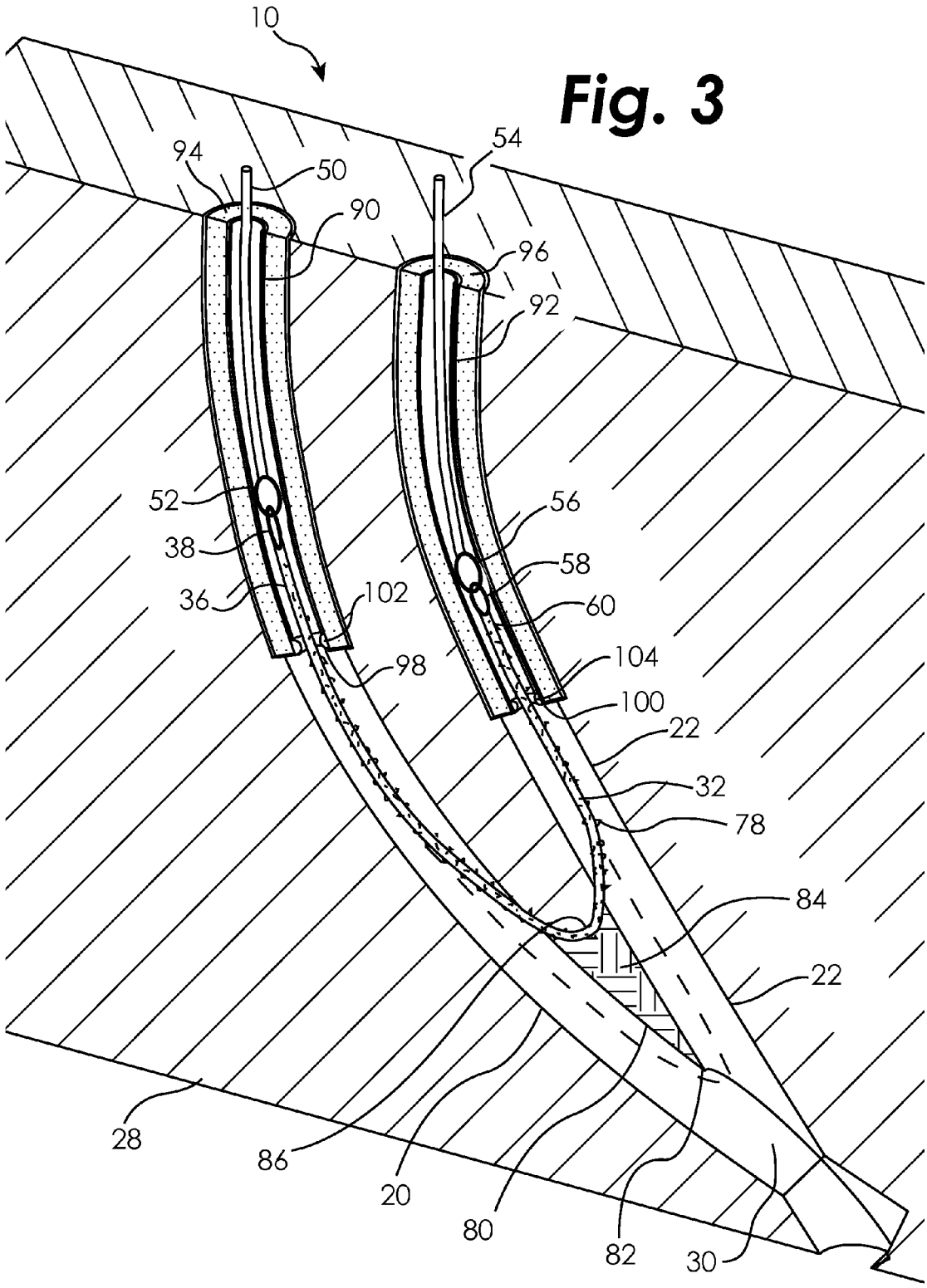
FIG. 3 illustrates a partially formed fissure beginning at the intersection of two well bores and being cut by a flexible linear cutting device in accordance with one illustrative embodiment of the invention.

In order to access both ends of the wire saw 32 from the surface 24, and because of the tensioning characteristics or expense of the wire saw 32, intermediate devices, such as cables or rods, can be connected to both ends of the wire saw 32. For example, as shown in FIG. 3, after fishing is complete an illustrative embodiment of the system 10 includes a first support cable 50 having a connector 52 coupled with the connector 38 at first end 36 of the wire saw 32, and a second support cable 54 having a connector 56 coupled to a connector 58 at second end 60 of the wire saw 32. The support cables 50 and 54 each extend upwardly through the first bore 20 and the second bore 22, respectively, and can be each coupled to a respective one of two actuating mechanisms 62 and 64 (FIG. 1) located at wellheads 66 and 68 at the junction of the surface 24 and the proximal ends of bores 20 and 22. Alternatively, tension rods or the like of appropriate size, strength, and other characteristics desirable for spanning a great distance and actuating the wire saw 32 can be substituted for the support cables 50 and 54.

Subsequent to the wire saw 32 being coupled, directly or indirectly, to the actuators 62 and 64, appropriate tensions and an axial motion, for example a reciprocating axial motion, can be applied to the wire saw 32 ends 36 and 60 in order to cut a fissure 80 (FIG. 3) in the space defined between the first bore 20 and the second bore 22. Specifically, the wire saw 32 includes a cutting element, for example diamond nubs 78 distributed on the surface of wire saw 32, capable of cutting the type of substrate located within target zone 26 at an axial speed of, for example, approximately 20 meters/second.

Alternatively, the wire saw 32 and any connected support cables 50 and 54 can be coupled at ends proximate to the surface 24 to form a single continuous or closed loop. The single loop that includes wire saw 32 can be translated along its axis in a reciprocating fashion, or in a single, continuous direction to cut the fissure 80. Such a continuous loop configuration for wire saw 32 can be implemented in a system 10 having one wellhead 66, or two or more wellheads 66 and 68 that are in sufficient proximity to complete the loop. A continuous loop that includes wire saw 32 can be used with one actuator 62 or 64, or more than one actuator.

The distal end 82 (FIG. 3) of the fissure 80 is located adjacent intersection 30 and extends proximally between bores 20 and 22 defining two narrowly spaced, opposing, and substantially ruled surfaces 84, i.e., a set of points or surface defined by the sweeping of a straight line. Thus, each surface 84, while not necessarily planar, will be defined between pairs of points located along the bores 22 and 24 as the wire saw 32 is tensioned and translated in order to cut the material wall 86 against which the wire saw 32 is tensioned. The resulting surfaces 84 will therefore be similar in contour shape to surfaces that can be formed by the flexing or straightening of a semi-rigid sheet of material. The particular contour shape of surfaces 84 depend on the relative positioning of bores 20 and 22 and local features in the sawed material such as strata and relative variations in hardness. Because the target zone 26 is exposed on both of the surfaces 84, the area of contact is roughly twice the area spanned by the fissure 80. The geometry and relative position of the fissure 80 is determined for the most part by the geometry and relative positions of the bores 20 and 22 in the target zone 26. Thus, the fissure 80 can be defined to maximize the contact with known porosity, for example, by maximizing the intersections of the fissure 80 with known fractures. For example, in shallow target zones where horizontal fractures have been mapped, the bores 20 and 22 can be positioned and shaped to define a fissure 80 having a vertical component, for example as shown in FIG. 1, to maximize the number of intersections with such fractures.

Reversing the direction of the wire saw 32 provides challenges to be addressed. For example, upon reversing, the wire saw 32 may stretch, for example 20 to 30 feet over a distance of 5000 feet, and because of the resulting tensions produced from static friction upon reversing, the wire saw 32 may jerk or otherwise inhibit smooth operation. Thus, the material used for wire saw 32 and the material used for the support cables 50 and 54 are selected to minimize such effects on smooth operation. For example, while a minimal amount of stretch may be desirable, generally materials with minimal stretch can be utilized.

Alternative flexible linear cutting devices can be substituted for the wire saw 32 discussed in all of the systems and methods above and below herein. For example, illustrative devices include other cable-type saws, for example, a chain, or a cable or other flexible or semi-rigid member having attached to it one or more high-pressure fluid cutting jets, electromechanical cutting tools, or electromagnetic cutting tools. The cutting of the fissure 80 can be accomplished by a reciprocating or non-reciprocating axial motion of the support cable and/or reciprocating or other action of individual cutting elements coupled to the supporting flexible component. The cutting element itself may or may not be flexible; however, a "flexible linear cutting device" as used herein includes a flexible component capable of being translated in a linear motion, such as a wire, cable, flexible rod, flexible tube, or the like, also includes or defines one or more cutting element, and may include associated support members 50 and 54, which may be flexible or rigid. For example, one or more rigid cutting elements, such as diamond nubs or other mechanisms for cutting, can be coupled to a flexible component such as a wire cable, which can be coupled to rigid or flexible rods or tubes. The cutting element may also include a component capable of motion complementing the linear motion of the flexible component, for example a reciprocating or rotating blade and drive mechanism coupled to a flexible tube. "Flexible" is understood to mean non-rigid, thus, the flexible component may be high flexible, semi-rigid, or some combination of or between the range of highly flexible and semi-rigid.

Referring generally to FIG. 1 and more specifically to FIG. 3, a portion or the full-length of bores 20 and 22 may include casings 90 and 92. Additionally, cement or other sealing material may be used to provide insulation layers 94 and 96 between the inner circumferences of each well bore 20 and 22 and the outer circumferences of each casing 90 and 92. Layers 94 and 96 isolate the casings 90 and 92 from different zones outside of the target zone 26 and also may provide sealing between formations in different zones that often contain fluids at different pressures.

The distal ends 98 and 100 of the casings 90 and 92, respectively, are generally located within the hydrocarbon horizon 28, may alternatively extend into the target zone 26, or may alternatively further extend to the intersection 30. The casings 90 and 92 and associated materials such as concrete help to isolate the production well from undesirable hydraulic flows within regions other than the target zone. For example, as shown in FIG. 1, the distal ends 98 and 100 of the casings 90 and 92 extend at least slightly into the hydrocarbon bearing horizon 28 thereby isolating the intermediate horizon 27 from the well bores 20 and 22.

Hydrocarbon production flow from within the target zone 26 is provided to the surface 24 by either terminating the casings 90 and 92 so that only the well bores 20 and 22 and fractures or fissures extend therefrom, or by perforating the casing 90 and 92 in the target zone 26, for example, by using directed explosive charges as is known in the art. In the present illustrative system 10, the casings 90 and 92 may be formed from a material through which wire saw 32 is capable of cutting a slot. Thus, the walls of the casings 90 and 92 can be perforated with a slot as the fissure 80 is being formed. Alternatively, the casings 90 and 92 may include hardened cable standoffs 102 and 104 or an alternative feature to protect the integrity of the casings 90 and 92 from being damaged by the wire saw 92 while the fissure 80 is being formed.

One of the bores 20 and 22, for example the first bore 20, can be used for hydrocarbon production while the second bore 22 can be used solely for the purpose of positioning and actuating the wire saw 32. Alternatively or additionally, the second well bore 22 could also be used for water drainage or other maintenance activities. For bores 20 and 22 having different assigned roles, one or both of the bores 20 and 22, can be much smaller in diameter. A smaller diameter bore requires a smaller drilling rig and associated equipment, less expense, and significantly less drilling fluids, cuttings, and other waste materials, thereby reducing environmental concerns. For example, one or both bores 20 and 22 can be 6 inches in diameter or less, or may be as small as 3 inches or even 2 inches in diameter or less, for example, those known in the art as a slimhole or microhole. For example, microhole technology (MHT) developed by the Department of Energy National Energy Technology Laboratory (DOE NETL) can be used in conjunction with the present systems and methods. Because the system 10 requires fewer down hole tools, the size of the first bore 20 used for production may also be a smaller diameter than that typically used for hydrocarbon production. In some cases a uniform bore size and casing strings may be used throughout the length of the first and/or second bore 20 and 22

Figure 4:
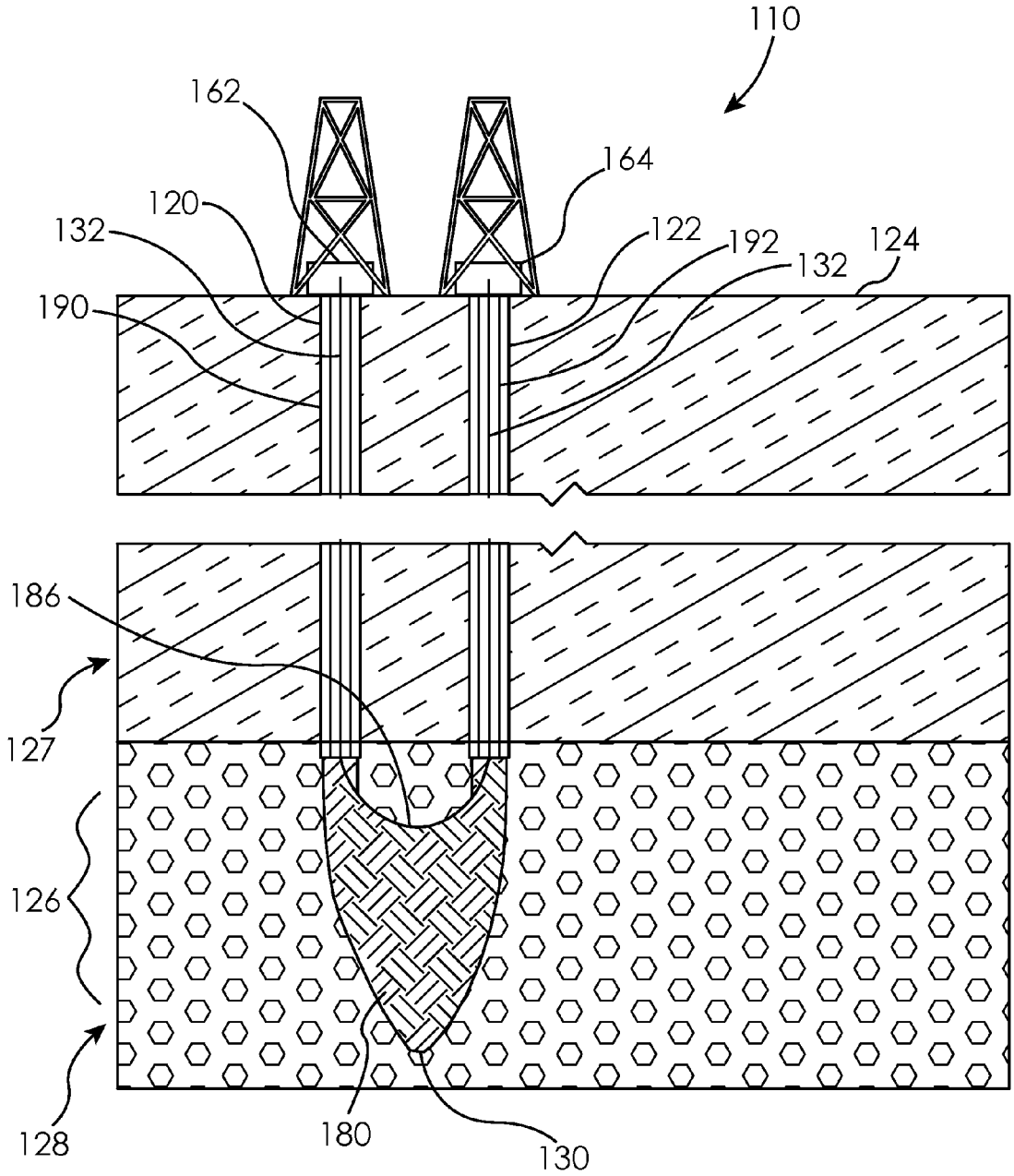
FIG. 4 illustrates a vertical cross-sectional view of another illustrative embodiment of the invention having two bores extending from the surface, the bores having portions extending substantially vertical within a hydrocarbon bearing horizon.

Referring to FIG. 4, which is a vertical cross-sectional view, an illustrative embodiment of a second system 110 includes two bores 120 and 122 extending from the surface 124 through intermediate horizon 127 and into hydrocarbon horizon 128 in similar fashion as for the first system 10. However, in the second system 110, the target zone 126 within hydrocarbon horizon 128 is oriented generally vertically; therefore, the bores 120 and 122 lack any substantial horizontal component within the hydrocarbon horizon 128 except that required to form the intersection 130 of the bores 120 and 122. Using the illustrative procedures discussed above for the first system 10, or using an alternative procedure known in the art, a fissure 180 is defined beginning at the intersection 130 and extending proximally toward the surface 124 to a wall 186 corresponding to the upper limit of the target region 126, for example wall 186 being located proximate to overlying horizon 127. The fissure 180 can be cut as discussed above, for example, using a wire saw 132 and one or more actuators 162 and 164. The system 110 may also utilize casings 190 and 192 and other conventional or adapted features known in the art.

One advantage to the fissure 180 having a vertical component is that in the case of the hydrocarbon horizon 128 containing multiple components, for example water or forms of hydrocarbon, the water or heavier hydrocarbons may settle to the lower elevation and the lighter hydrocarbons may rise to the upper elevation. For example, referring briefly again to FIG. 1, the first bore 20, which is located at a lower elevation within the target zone 26, can be used for removal of water or heavier hydrocarbons, while the second bore 22, which is located at a higher elevation, can be used for production of lighter hydrocarbons. Such a configuration of the present systems and methods prevents having to pump the mixture to the surface 24 and separate hydrocarbons and/or impurities above ground.

Figure 5:
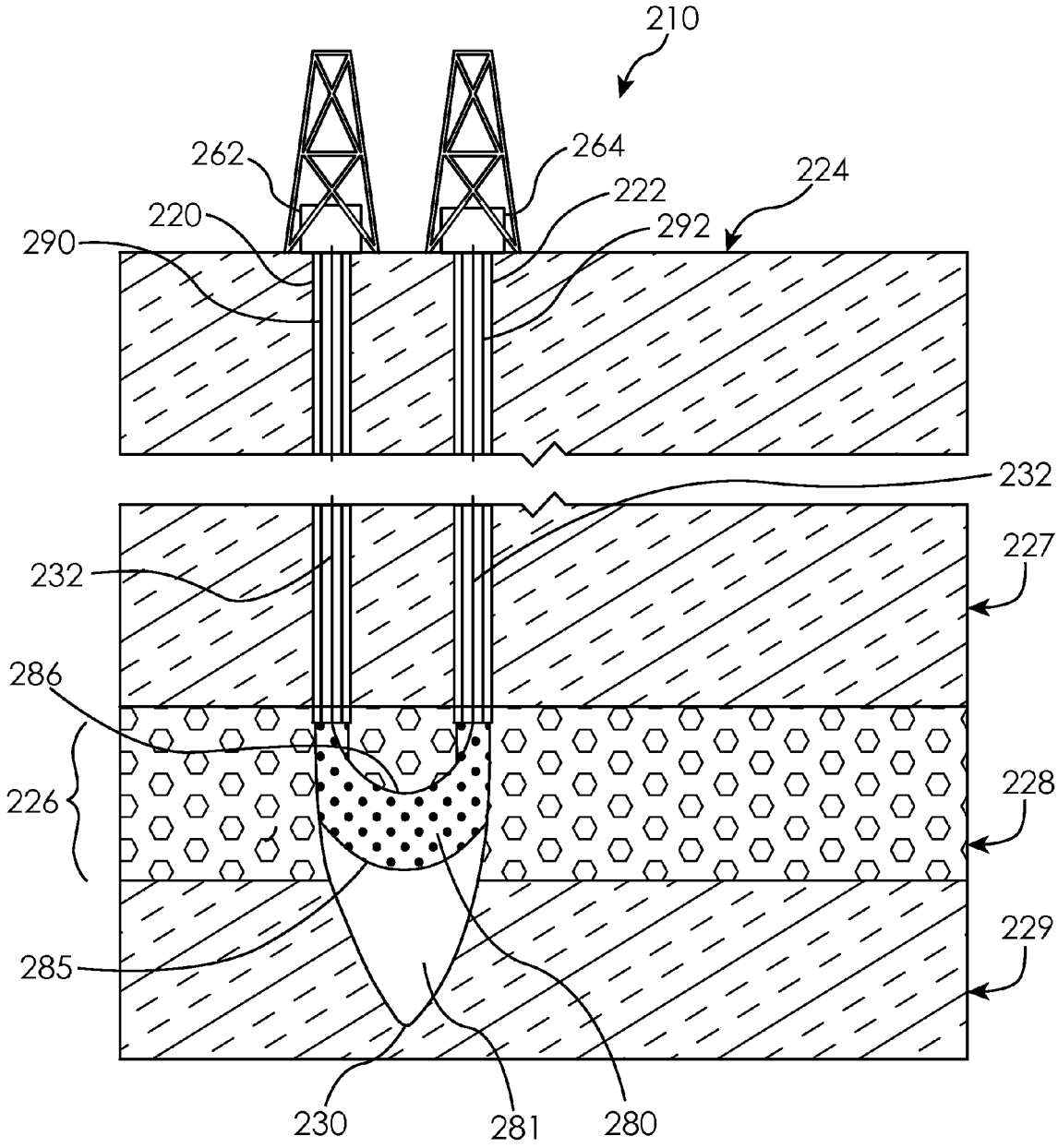
FIG. 5 illustrates a vertical cross-sectional view of an illustrative embodiment of the invention having two bores extending from the surface, and the bores intersecting beneath a hydrocarbon bearing horizon.

Referring to FIG. 5, which is a vertical cross-sectional view of an illustrative embodiment of a third system 210, it sometimes may be desirable to locate the intersection 230 of the bores 220 and 222 in a subhorizon 229 located beneath hydrocarbon horizon 228. For example, the third system 210 may be utilized in cases when a very thin target zone 226 causes horizontal drilling to be difficult or otherwise undesirable. In order to isolate the potentially non-uniform hydraulics and material of the subhorizon 229 from the fissure 280 and the bores 220 and 222, cement or other sealing material is located in a lower region 281 of the fissure 280. For example, once the wire saw 232 is completely within the target zone 226 along line 285, the lower region 281 of the fissure 280 can be filled with cement.

To place the cement, a packer of the type that allows a cable, for example including or attached to wire saw 232) to pass through its center or by its side can be used, for example, those available from Baker Hughes of Houston, Tex., and/or the subject of U.S. Pat. Nos. 4,798,243 and 6,325,144; from Atlantic Richfield Company of Bakersfield, Calif., and/or the subject of U.S. Pat. No. 5,291,947; or from Halliburton Company of Houston, Tex., and/or the subject of U.S. Pat. No. 4,834,184. Alternatively, a modification of one of these or another packer specifically designed to seal against a cable along its annulus against a casing or open hole. Additionally or alternatively, a packer may be sealed around the wire saw 232 at the surface 224 and then lowered down while translating the wire saw axially. The packer can be designed to allow the cable to be pulled free from the seal along the packer without dislodging the packer, and the wire saw 232 can be kept moving without enough tension for cutting in order to prevent the saw from becoming lodged in the drying cement. After allowing the cement time to dry sufficiently, sawing of the fissure 280 can be continued within the target zone 226 proximally toward the surface 224 to the wall 286. Similar to the systems 10 and 110, system 210 may include casings 290 and 292 extending through an intermediate horizon 227 and into the target horizon 228, and one or more actuators 262 and 264.

Figure 6:
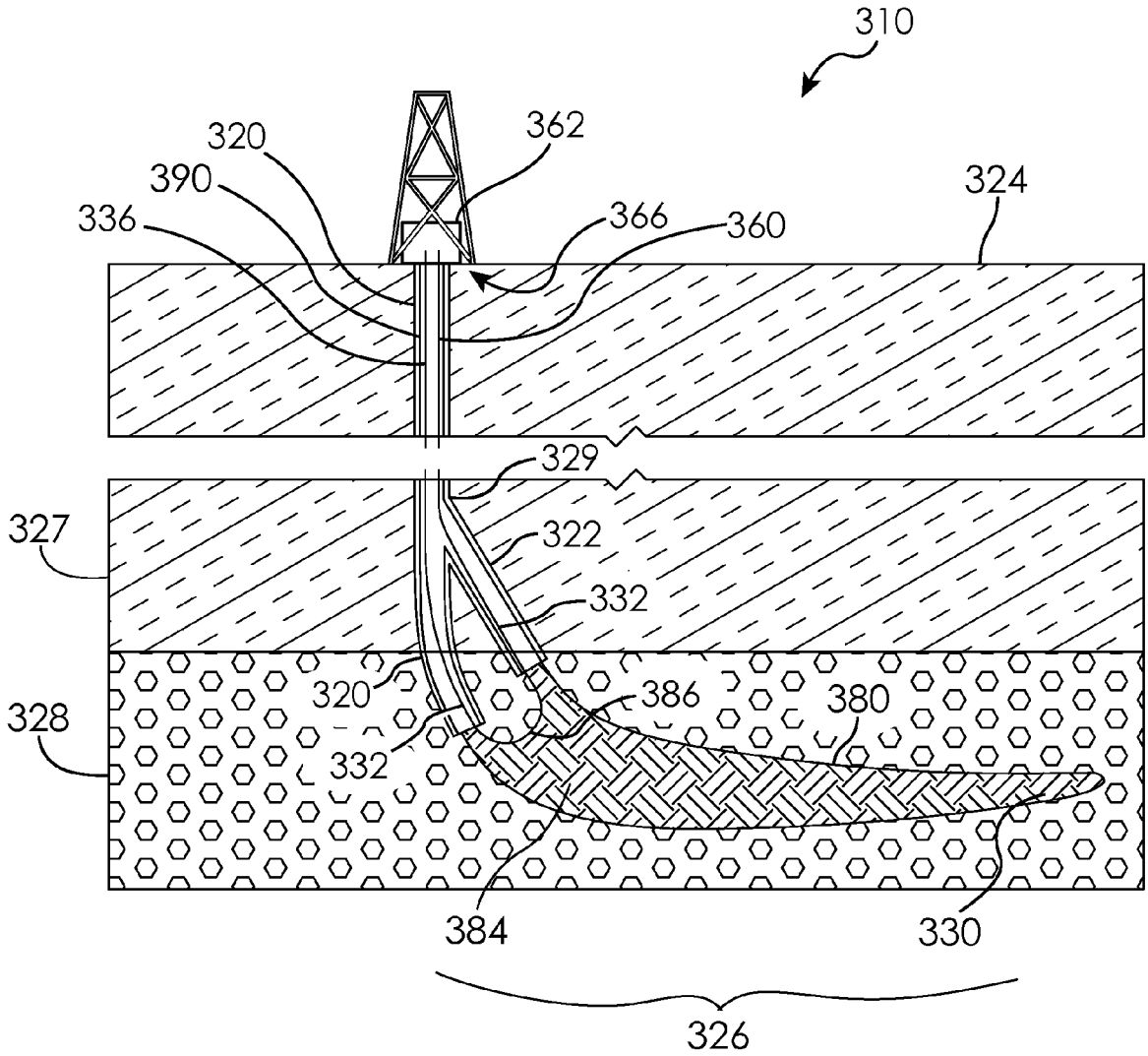
FIG. 6 illustrates a vertical cross-sectional view of an illustrated embodiment of the invention having one bore extending from the surface, a second bore extending from a whipstock of the first bore, and a distal intersection of the two bores located within a hydrocarbon bearing horizon.

Referring to FIG. 6, which is a vertical cross-sectional view of an illustrative embodiment of a fourth system 310, a single wellhead 366 provides access to form and produce hydrocarbons from a first bore 320 and a second bore 322. The second bore 322 deviates from the first bore 320 at a first intersection 329. The first intersection 329 may be located above the hydrocarbon horizon 328 in the intermediate horizon 327 as shown in FIG. 6, or may be located within the hydrocarbon horizon 328. The bores 320 and 322 are directionally drilled to form a second intersection 330 which may be located, for example, within target zone 326 of hydrocarbon horizon 328. The second bore 322 may be deviated from the first bore 320 as is known in the art, for example by using a whipstock located at the first intersection 329. The bores 320 and 322 may include one or more casings 390.

Advantageously, the use of a single wellhead 366 can reduce drilling cost and allow both cable ends 336 and 360 of the wire saw 332 (ends 36 and 60, FIG. 3), or both ends of the support cables 50 and 54 (FIG. 3) to be fed to the same actuating mechanism 362, thus simplifying the coordination required between two actuating mechanisms 62 and 64 as in the system 10 of FIG. 1. For example, the wire saw 32 and any included support cables 50 and 54 can be connected into a continuous loop that is then translated along its axis for cutting the fissure 380. The resulting translation is similar to the continuous axial motion of a saw blade on a band saw. The actuator 362 can be located at surface 324 or can be located subterranean, for example at or near the intersection 329.

Although the fourth system 310 is shown having a fissure 380 with a vertical component and spanning a substantially horizontal target zone 326 between the second intersection 330 and the proximal wall 386, the bores 320 and 322 may be oriented relative to one another to define an alternative orientation or a varying orientation for the fissure 380. For example, regardless of the vertical offset between the bores 320 and 322, the bores 320 and 322 have a substantial lateral offset at the proximal wall 386 and continue substantially parallel until finally turning inward toward one another to form the second intersection 330, thus maximizing the span of the fissure 380 while remaining within the target region 326. Similarly, regardless of the horizontal offset between the bores 320 and 322, the bores 320 and 322 may have a large vertical offset at the proximal wall 386 and continue substantially parallel until finally turning vertically toward one another to form the second intersection 330.

Additionally, the substantially ruled surfaces 384 defined by the fissure 380 may twist, vary in span, or be otherwise non-uniform in orientation and geometry, between the proximal wall 386 and the second intersection 330 so that the fissure 380 is located as desired, for example to maximize intersections with natural or pre-existing fissures or fractures or with other features promoting hydrocarbon production within the target zone 326. For example, natural or pre-existing fractures or fissures can be mapped during the drilling of the first bore 320 using methods known in the art, such as High Resolution Dipmeter Logging. Subsequent to the mapping, the second bore 322 can be located to maximize intersections of the fissure 380 with natural or pre-existing fractures or fissures. Thus, the fissure 380 may be defined to include any desired orientation, including horizontal, non-horizontal, vertical, and non-vertical components relative to the surface 324.

Additionally, the fourth system 310 may include additional fissures (not shown) that are formed using at least one of the bores 320 and 322 or by using other bores drilled from the wellhead 366 or other wellheads (not shown). The above discussed variations of the system 310 and other variations as may be known in the art may also be used in combination with or substituted for the features of the above discussed systems 10, 110, and 210.

Figure 7A:
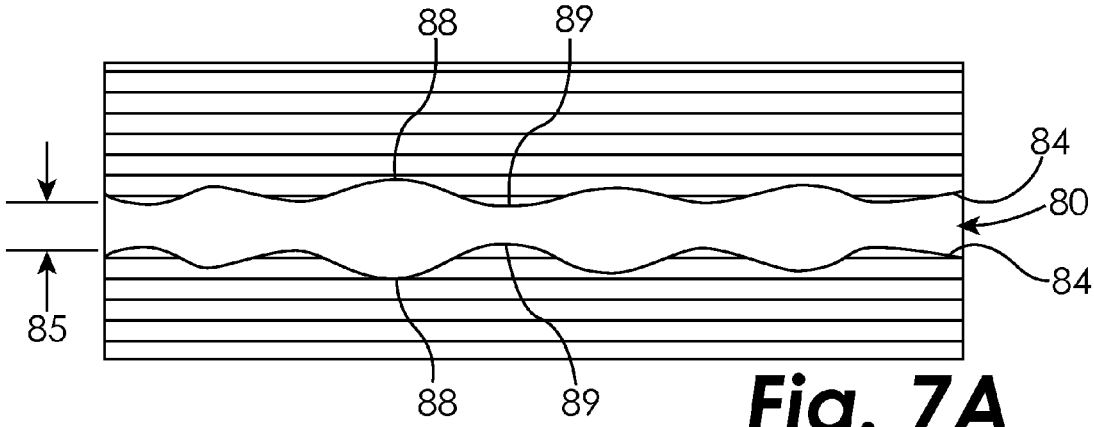
FIG. 7A illustrates a vertical cross-sectional view of a fissure of non-uniform thickness formed in accordance with one illustrative embodiment of the invention.
Figure 7B:
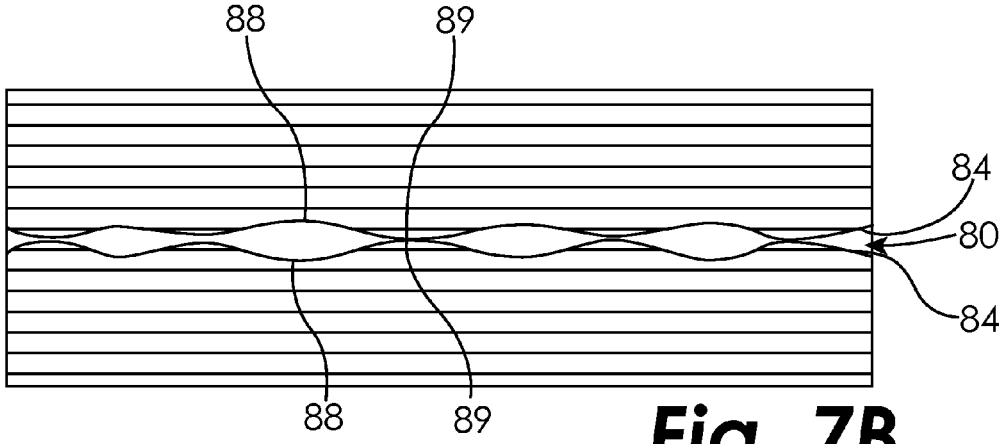
FIG. 7B illustrates a vertical cross-sectional view of the fissure of FIG. 7A after subsequent reduction of thickness.
Figure 7C:
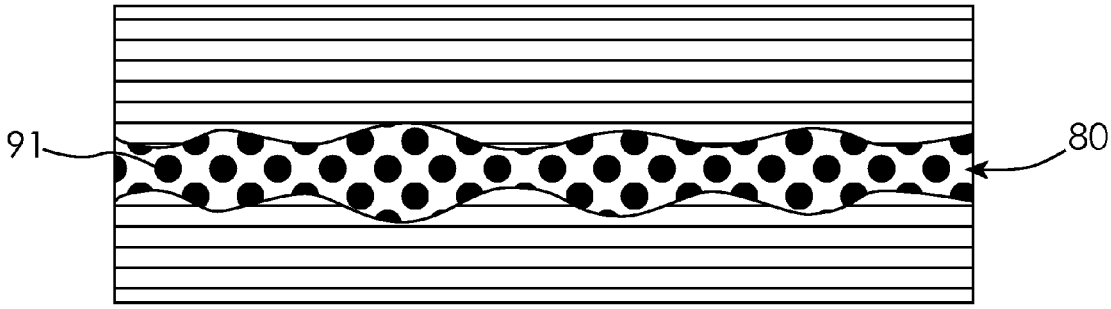
FIG. 7C illustrates a cross-sectional cross-sectional view of the FIG. 7A packed with material to prevent subsequent reduction of thickness.

Referring to FIGS. 7A-7C, in certain formations, opposing surfaces 84 of fissures 80 may be forced toward one another, substantially closing the opening formed by fissures 80 and inhibiting the production of hydrocarbons. Typical causes include substrate swelling and the weight of the overlying strata.

FIG. 7A is a cross-sectional view of a newly formed fissure 80 and illustrates a thickness or kerf 85 between opposite surfaces 84 of the fissure 80. The thickness 85 can generally be controlled by varying the size of the flexible linear cutting device, and may be, for example, between ¼ inches and 2 inches; however, thinner and wider thicknesses can be provided with the present systems and methods. In the case of the linear cutting device being a wire saw 32, selection of the thickness 85 can be controlled by the diameter of the cable and the size of the nubs 78 (FIG. 2). When compared to hydro-fracturing, the thickness 85 of the fissure 80 can be many times greater than that created by hydro-fracturing. Therefore, the fissures 80 according to the present systems and methods are not as prone to clogging or becoming impeded as it would be if created using other techniques.

In certain cases it may be desirable to vary the thickness 85 along the length and/or span of the fissure 80, thus providing concave features 88 and convex features 89 for each of the opposing surfaces 84. In such a configuration it is desirable that concave features 89 are generally aligned; therefore, if opposing surfaces 84 of fissure 80 are forced toward one another, as shown in FIG. 7B, the combination of convex features 89 and concave features 88 will prevent complete closure of the fissure 80, thus maintaining porosity. Additionally or alternatively, as shown in FIG. 7C, packing or filling material 91, for example sand, gravel, or other natural or synthetic fluid permeable materials that resist crushing known in the art, may be used to fill the fissure 80 between the opposing surfaces 84 thereby preventing complete closure and excessive reduction of hydrocarbon production. Because the fissure 80 is formed without excessive pressure, as is the case in hydro-fracturing, the material 91 can be injected into the fissure 80 without requiring typical pressures generally associated with this process.

While the invention has been illustrated and described in detail in the foregoing drawings and description, the same is to be considered as illustrative and not restrictive in character, it being understood that only illustrative embodiments thereof have been show and described and that all changes and modifications that are within the scope of the following claims are desired to be protected. For example, while the disclosure has included certain features and techniques in the above described systems and methods, other techniques or combinations known in the art other than those discussed in the disclosure can be substituted.

The invention claimed is:

1. A well system for a hydrocarbon zone, comprising:

a first bore having proximal and distal ends, the proximal end forming a wellhead;

a second bore having proximal and distal ends;

a first intersection defined by the first bore and the second bore at their respective distal ends; and a fissure defined between and spanning at least a portion of the length of the first bore and the second bore, the fissure having a distal end at the first intersection of the first and second bores.

2. The hydrocarbon well system of claim 1, wherein the fissure defines a substantially ruled surface.

3. The hydrocarbon well system of claim 2, wherein the ruled surface is oriented substantially horizontal.

4. The hydrocarbon well system of claim 2, wherein at least one of the first bore and the second bore has at least a portion oriented substantially horizontal within the hydrocarbon zone.

5. The hydrocarbon well system of claim 4, wherein the ruled surface is oriented substantially vertically.

6. The hydrocarbon well system of claim 1, wherein:

a proximal end of the second bore forms a wellhead; and an interior angle formed by the first intersection of the first and second bores is an acute angle.

7. The hydrocarbon well system of claim 1, wherein the proximal end of the second bore forms a second intersection with the first bore at a point between the first intersection and the proximal end of the first bore.

* * * * *